US006985596B2

(12) United States Patent
Bank et al.

(10) Patent No.: US 6,985,596 B2
(45) **Date of Patent: *Jan. 10, 2006**

(54) LOUDSPEAKERS

(75) Inventors: Graham Bank, Cambridgeshire (GB); Neil Harris, Cambridge (GB); Denis Morecroft, Cambridgeshire (GB)

(73) Assignee: New Transducers Limited, Cambridgeshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/384,419

(22) Filed: Aug. 27, 1999

(65) Prior Publication Data

US 2002/0067841 A1 Jun. 6, 2002

(30) Foreign Application Priority Data

Aug. 28, 1998 (GB) ..... 9818719

(51) Int. Cl.
*H04R 25/00* (2006.01)

(52) U.S. Cl. ..... 381/152; 381/386; 381/398

(58) Field of Classification Search ..... 381/152, 381/337, 190, 386, 398, 431, 87, 162, 163, 381/173, 182, 191, 423; 181/171–173; 310/311, 310/322, 324, 327–334

See application file for complete search history.

(56) References Cited

U.S. PATENT DOCUMENTS 3,509,290 A * 4/1970 Ishimura et al. ..... 381/431
4,191,863 A * 3/1980 Matsuda et al. ..... 381/431
4,352,961 A * 10/1982 Kumada et al. ..... 381/190
4,593,160 A * 6/1986 Nakamura ..... 381/190
4,654,554 A 3/1987 Kishi ..... 381/158
4,763,358 A * 8/1988 Danley ..... 381/337
4,885,781 A * 12/1989 Seidel ..... 381/190
5,317,642 A 5/1994 Danley et al. ..... 381/182
5,901,231 A * 5/1999 Parrella et al. ..... 381/190
6,003,766 A * 12/1999 Azima et al. ..... 235/379
6,031,926 A * 2/2000 Azima et al. ..... 381/423
6,144,746 A * 11/2000 Azima et al. ..... 381/152
6,151,402 A * 11/2000 Azima et al. ..... 381/152
6,169,809 B1 * 1/2001 Azima et al. ..... 381/190
6,307,942 B1 * 10/2001 Azima et al. ..... 381/152
6,332,029 B1 * 12/2001 Azima et al. ..... 381/152
6,522,760 B2 * 2/2003 Azima et al. ..... 381/152
2003/0007653 A1 * 1/2003 Azima et al. ..... 381/152

OTHER PUBLICATIONS

Patent Abstract of Japan, vol. 010, No. 228 (E–426), Aug. 8, 1996 & JP 61 061598 A (Matsushita Electric Industries Co., Ltd., Mar. 29, 1986.

* cited by examiner

*Primary Examiner*—Suhan Ni
(74) *Attorney, Agent, or Firm*—Foley & Lardner LLP

(57) ABSTRACT

A loudspeaker comprising a resonant panel-form member adapted to produce an acoustic output and a vibration exciting system on the panel-form member and adapted to apply bending wave energy thereto, characterized in that the vibration exciting system is adapted to apply a bending couple to the panel-form member.

22 Claims, 14 Drawing Sheets

Fig. 20.
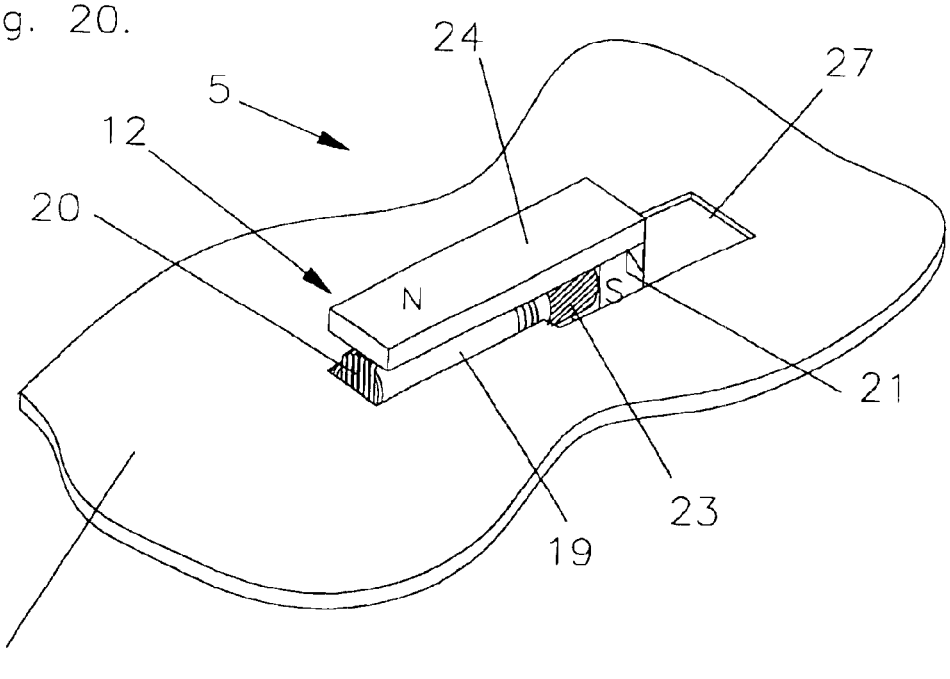
Fig. 21a
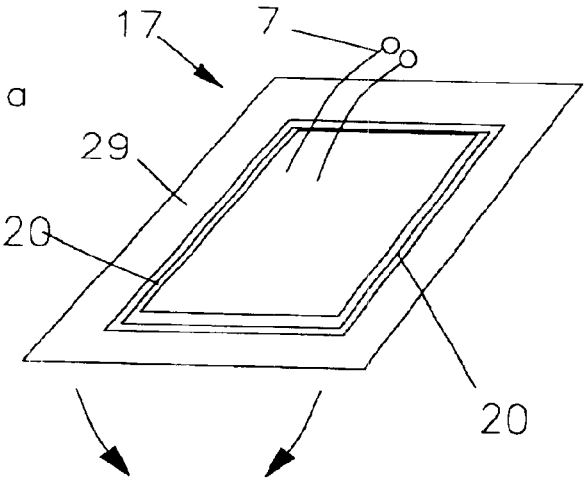
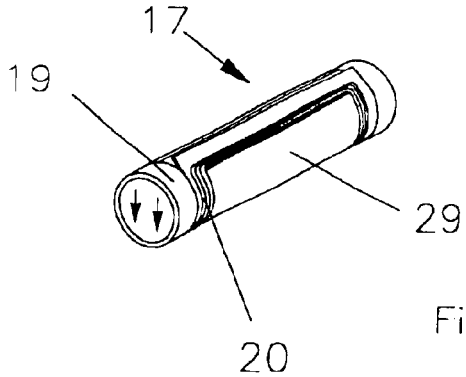
Fig. 21b

Fig. 24.
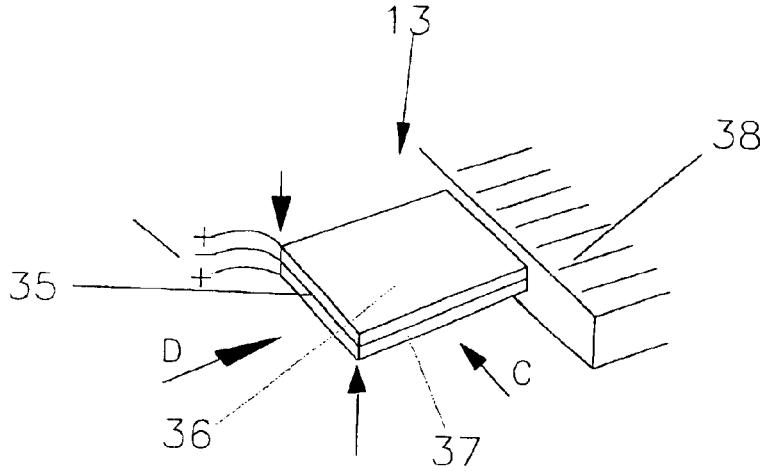
Fig. 24a.
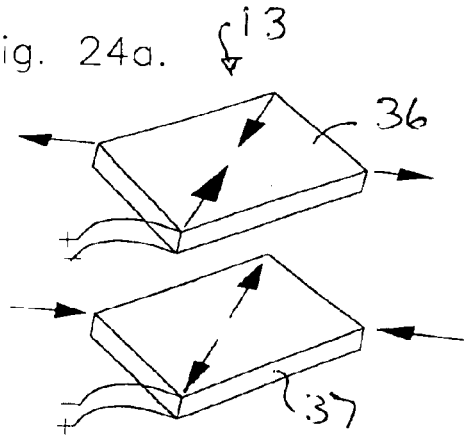
Fig. 24b.
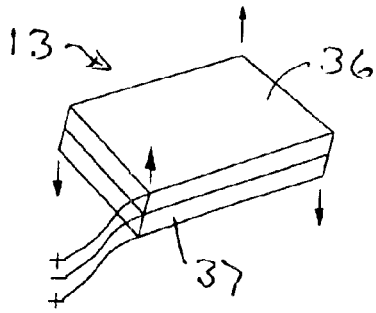
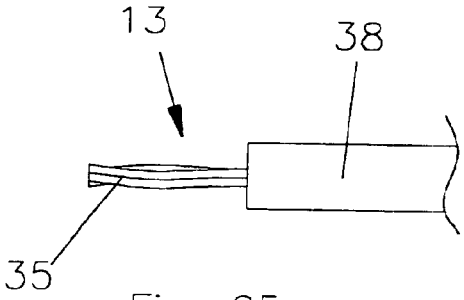
Fig. 25.
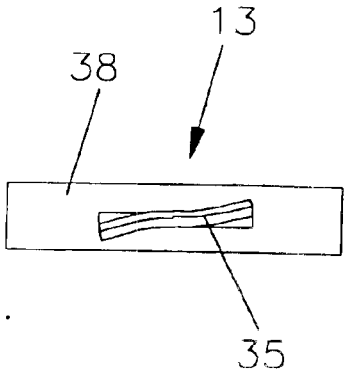
Fig. 26.

LOUDSPEAKERS

BACKGROUND

1. Field of the Invention

The invention relates to loudspeakers and more particularly, but not exclusively, the invention relates to vibration exciters for exciting resonance in resonant panel-form loudspeakers e.g. of the general kind described in our published International patent application WO97/09842 and which have become known as 'distributed mode' loudspeakers.

2. Description of the Related Art

A known form of exciter used to drive a distributed mode loudspeaker panel is based on converting an electrical input into a force which is applied normal to the panel surface. This generates bending waves which emanate from the drive point. By suitably positioning this point on the loudspeaker panel, the modes in the panel can be coupled with sufficient density to make the panel act as a loudspeaker.

A disadvantage of this method of panel excitation is that it is usually preferable for the force to be applied near to the central portion of the panel, which would, for example, be impractical for a transparent panel, used in association with a visual display, where the vibration exciter should not be visible.

Bending waves derived from a typical force exciter also cause whole body (i.e. timpanic) mode, whose radiated sound field may interfere with a boundary placed parallel to, and in close proximity with, the rear of the panel, to form a cavity. With such a cavity behind a panel the whole body mode may appear at an undesirably high frequency. This limits the low frequency range of the loudspeaker, and may also result in an excessive resonance or peak in the frequency response at the dominating coupled system resonance.

It is an object of the invention to provide a method and means for exciting a resonant loudspeaker panel near to an edge of the panel.

It is another object of the invention to provide a method and means for exciting a resonant loudspeaker panel which will reduce the excitation of whole body modes.

SUMMARY OF THE INVENTION

According to the invention a loudspeaker comprising a resonant panel-form member adapted to produce an acoustic output and a vibration exciting system on the panel-form member and adapted to apply bending wave energy thereto, is characterised in that the vibration exciting system is adapted to apply a bending couple to the panel-form member.

The vibration exciting system may be adapted to apply torsion to the panel-form member. Alternatively or additionally, the vibration exciting system may be adapted to apply shear to the panel-form member.

The vibration exciting system may be coupled to the panel-form member to span a plurality of nodal lines in the panel-form member.

The vibration exciting system may comprise a suspension on which the panel-form member is mounted, the suspension acting as a pivot about which at least a portion of an edge of the panel-form member local to the vibration exciting system can hinge. The suspension may be of a plastics foam of high shear stiffness.

The vibration exciting system may comprise a piezoelectric device attached to the panel-form member to apply a bending couple thereto by introducing alternating tension and compression to the panel-form member in the plane thereof. The piezoelectric device may be attached to a face of the panel-form member. Mirror-image piezoelectric devices may be attached to opposite faces of the panel-form member. The or each piezoelectric device may be a unimorph device. The piezoelectric device may have a portion disposed adjacent to the suspension, and a portion disposed remotely from the suspension. The piezoelectric device may be a thin strip-like device fixed to the panel-form member by adhesive. The piezoelectric device may be of PZT. The panel-form member may be transparent. The piezoelectric device may be transparent. The vibration exciting system may comprise an inertial device. The inertial device may comprise an inertial mass fixed to the panel-form member to prevent relative movement therebetween. The inertial device may be an inertial vibration exciter. Opposed inertial vibration exciters may be provided on opposite sides of the panel-form member. An additional inertial vibration exciter may be provided on the panel-form member and coupled to the first said inertial vibration exciter in anti-phase to damp unwanted whole body movement of the panel-form member.

The vibration exciting system may comprise an electrodynamic motor comprising a rotor having a current carrying conductor array fixed to the panel-form member and disposed with its axis parallel to the plane of the member and means generating a local magnetic field in which the rotor is positioned to apply torsion to the member.

The vibration exciting system may comprise a piezoelectric device which is generally rectangular and orientated diagonally to act as a twister. The vibration exciting system may comprise an element rigidly coupled to and projecting away from the panel-form member, and means to induce bending moments in the element. The element may be generally perpendicular to the panel-form member, and bending moments may be produced by displacement in a part of the element spaced from the panel-form member, the displacement being generally perpendicular to the element. The displacement may be effected using a piezoelectric device. The displacement may be effected by an inertial device.

From another aspect the invention is a method of making a loudspeaker having a resonant panel-form member adapted to be excited to produce an acoustic output by the application of bending wave energy, comprising defining the panel-form member, mapping the panel-form member to determine the location of nodal lines, arranging a vibration exciting system on the panel-form member to apply bending wave energy thereto, with the exciting system spanning a plurality of the nodal lines and mounting the vibration system exciting to the panel-form member to apply a couple thereto.

The panel-form member may be defined in terms of geometry, size and/or mechanical impedance.

The panel-form member may be mapped using finite element analysis.

The method may comprise mounting the panel-form member on a suspension such that the suspension acts as a pivot about which an adjacent portion of the panel-form member can hinge, and arranging and mounting a vibration exciter on the adjacent portion of the panel-form member to bend the panel-form member.

From another aspect the invention is a vibration exciter for applying bending wave energy to a member and adapted to apply a bending couple to the member.

BRIEF DESCRIPTION OF THE DRAWINGS

The invention is diagrammatically illustrated, by way of example, in the accompanying drawings, in which:

FIG. 20 is a perspective view of part of a loudspeaker showing the exciter of FIG. 18 in position;

FIGS. 21*a* and 21*b* are perspective sketches showing steps in the formation of a voice coil for the exciter of FIG. 18;

FIG. 24 is a perspective view of an embodiment of piezoelectric bimorph torsional vibration exciter fixed to a ground;

FIGS. 24*a* and 24*b* are respective perspective views showing the construction of the bimorph exciter of FIG. 24;

FIG. 25 is a view in the direction of arrow 'C' of FIG. 24, and

FIG. 26 is a view in the direction of arrow 'D' of FIG. 24.

DETAILED DESCRIPTION OF THE INVENTION

Figure 1:
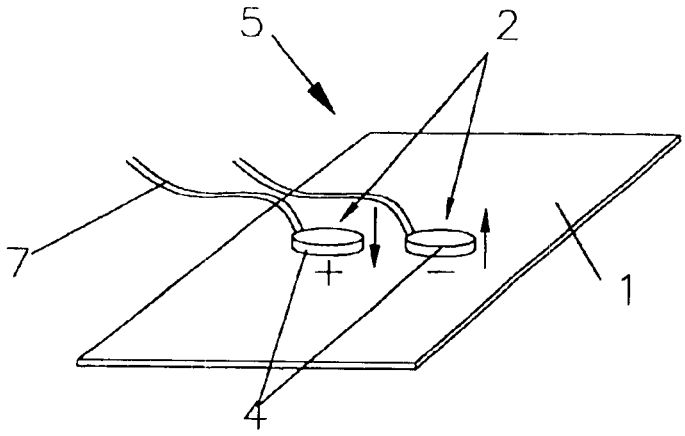
FIG. 1 is a perspective view of a first embodiment of loudspeaker according to the invention.

In the drawings there are shown and described several embodiments of resonant panel-form loudspeaker of the general kind described in published International patent application WO97/09842 and having novel forms of vibration exciting systems intended to prevent or reduce the exciting of whole body modes in the panel, and/or adapted for placement away from the central area of the panel.

In FIG. 1 there is shown a loudspeaker 5 having a resonant panel-form member 1 which is excited to resonate by a vibration exciting system 2 comprising a pair of inertial electrodynamic vibration exciters 4 energised via signal leads 7, the exciters being spaced apart on the panel and working in opposition to create a rocking couple to bend the panel to launch bending wave vibration therein.

Figure 2:
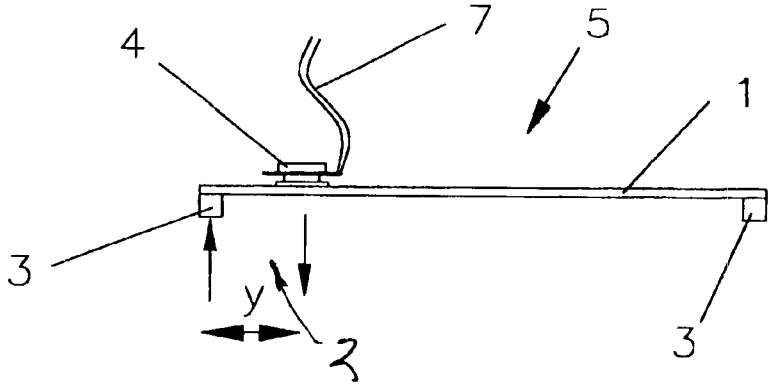
FIG. 2 is a side view of a second embodiment of loudspeaker according to the invention.
Figure 3:
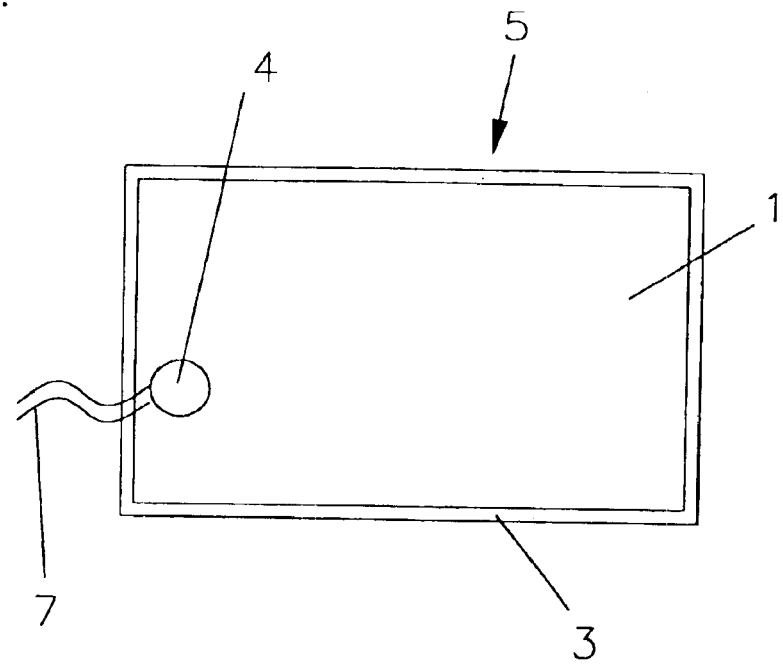
FIG. 3 is a plan view of the loudspeaker of FIG. 2.

FIGS. 2 and 3 show an embodiment of loudspeaker 5 in which a vibration exciting system 2 for launching bending wave vibration into a resonant panel 1 comprises a peripheral panel suspension 3, e.g. of high shear stiffness foam plastics, e.g. foamed polyvinylchloride, which is such that it resists deflection of the panel periphery but acts as a pivot to allow the panel to hinge about the suspension, and an inertial electrodynamic vibration exciter 4 mounted on the panel at a distance inwards from the panel periphery and which launches bending waves into the panel using the suspension 3 as a fulcrum.

Figure 2A:
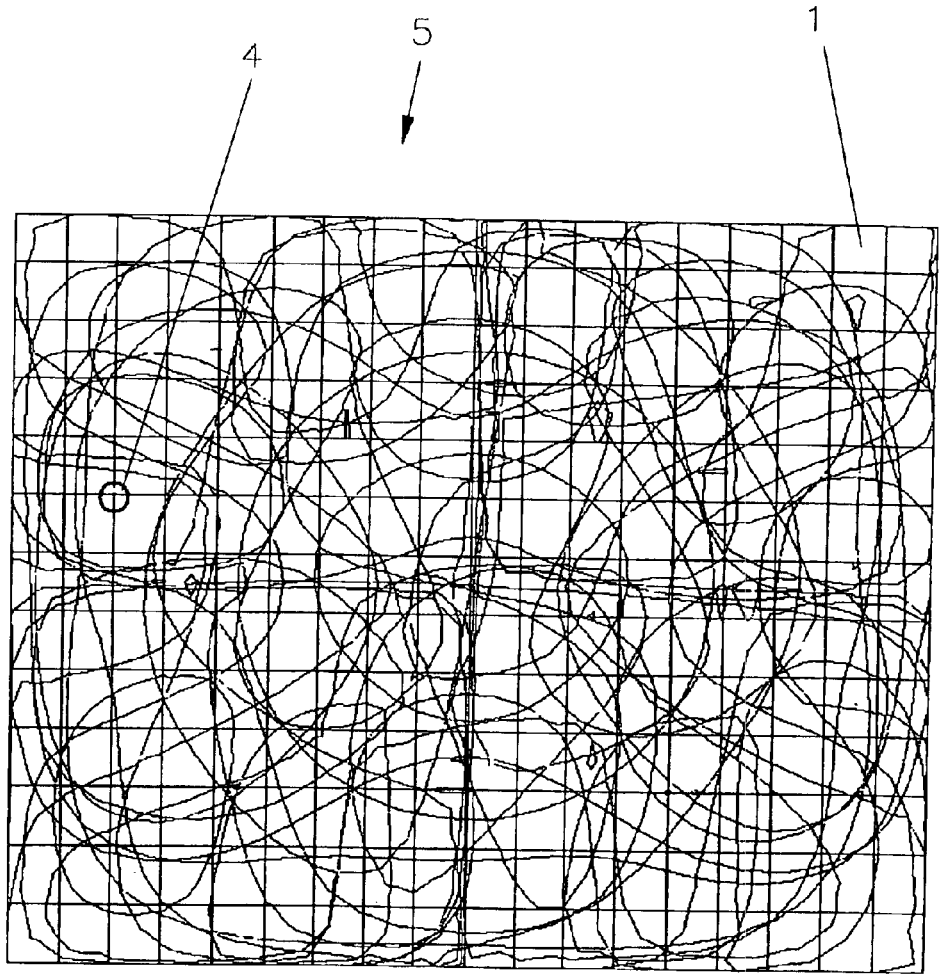
FIG. 2*a* is a nodal map of the loudspeaker of FIG. 2 and for comparison
Figure 2B:
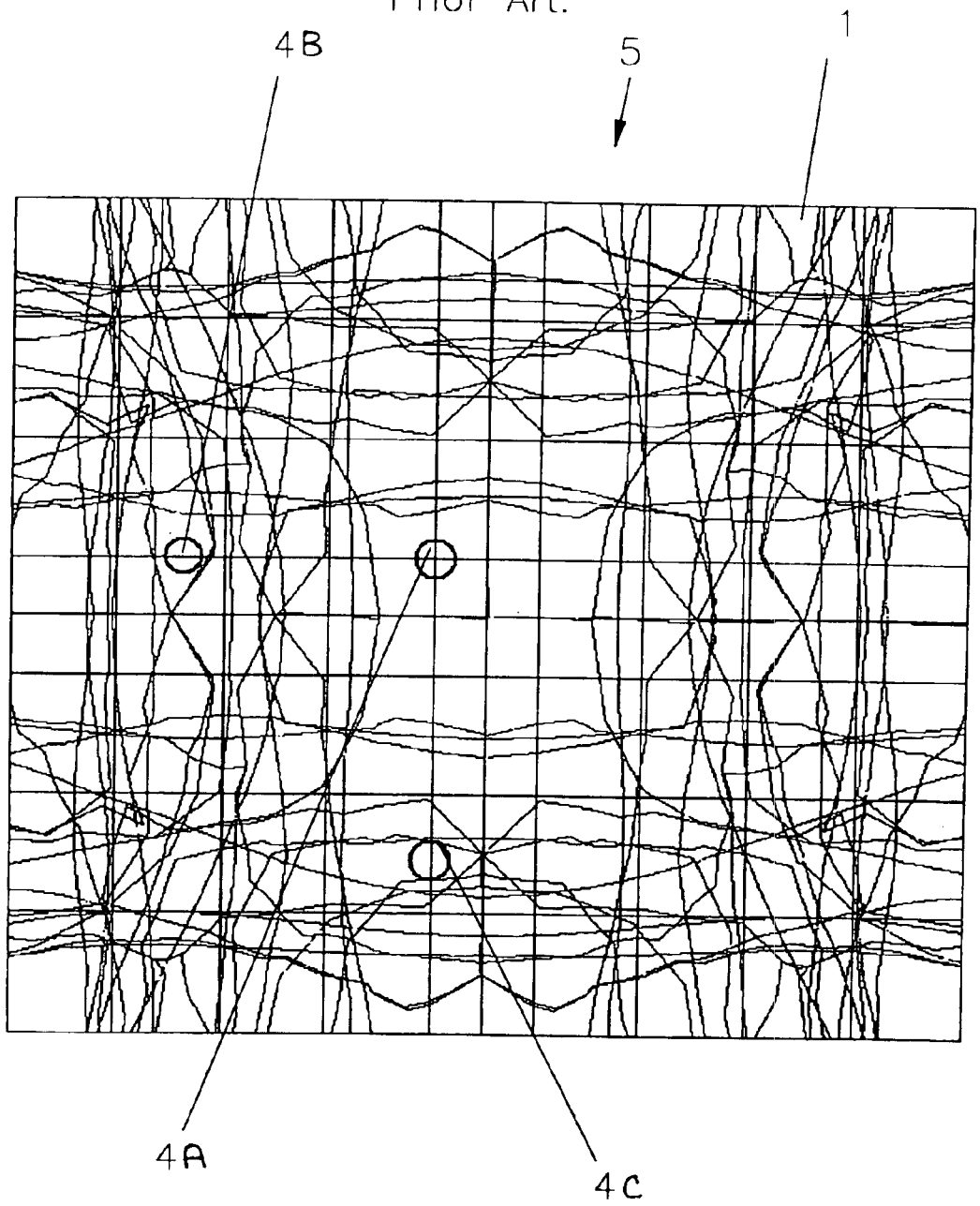
Fig. 2b. Prior Art.
FIG. 2*b* shows a nodal map of a prior art freely-suspended loudspeaker panel.

As shown in FIG. 2*a*, the effect of mounting the panel 1 on a relatively rigid suspension which acts as a pivot or hinge (in mechanical terms which may be described as "simply supported") is to move nodal lines in the panel and running generally parallel to the panel edge towards the panel edge, as compared to the position of the corresponding nodal lines in a generally corresponding but resiliently or freely edge-suspended panel, see FIG. 2*b*, and the exciter 4 is positioned inboard of the panel periphery so that the vibration exciting system comprising the edge suspension 3 and the exciter 4 bridges across several of these nodal lines. We have found that this is important in producing effective panel excitation, and that positioning the exciter outboard of these nodal lines does not result in such useful panel excitation.

FIG. 2*b* shows the preferred exciter position taught in WO97/09842 at A while two alternative near panel edge drive positions are shown at B and C respectively. It will be seen that the B and C locations are nevertheless at a considerable distance inboard from the panel edge and do not lend themselves to a loudspeaker arrangement in which the exciter must be hidden from view, e.g. one in which the loudspeaker panel is transparent and forms part of a display screen. The arrangement shown in FIGS. 2, 2*a* and 3 overcomes or mitigates this difficulty.

FIG. 2 shows a couple of length y produced by the excitation system 2. It will be appreciated that in this embodiment where the excitation system 2 comprises the suspension 3, the suspension need act as a pivot or hinge only in the region local to the exciter 4 and that the peripheral panel suspension in other locations might be of the resilient kind e.g. of soft foam rubber. Nevertheless experiments have shown that if desired the peripheral suspension may be continuous and may be wholly of the foam high shear stiffness plastics.

Figure 4:
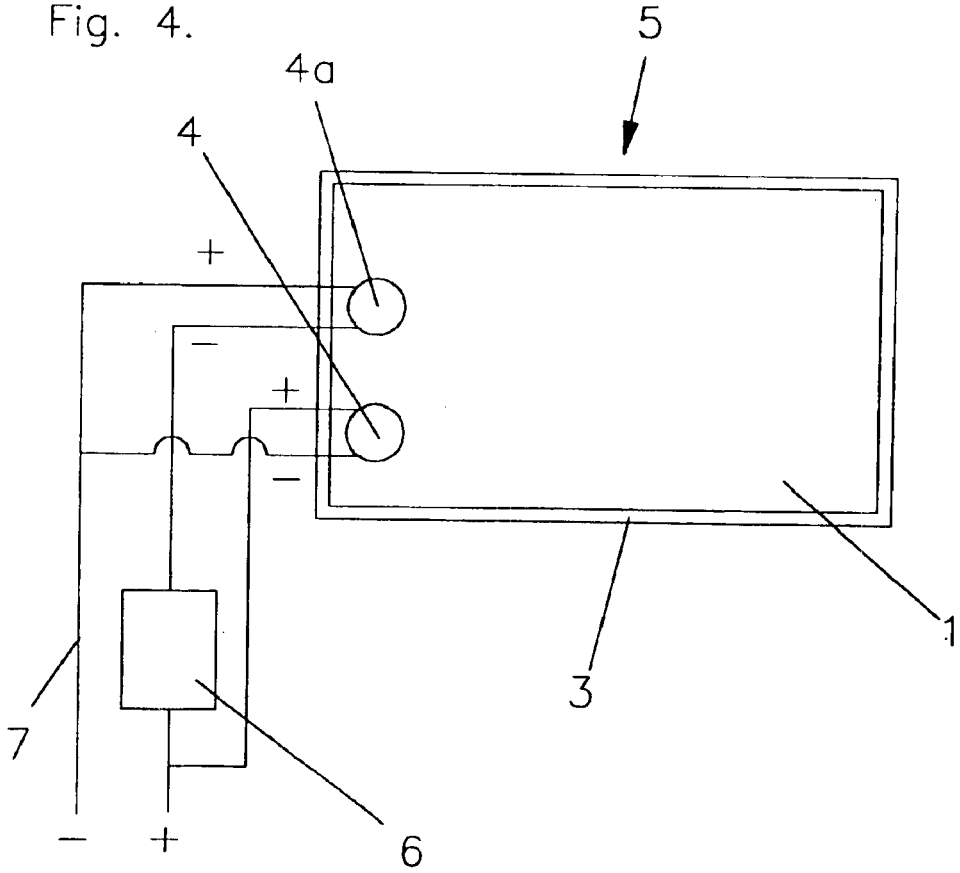
FIG. 4 is a plan view of a variant of the loudspeaker of FIGS. 2 and 3.

Referring to FIG. 4, there is shown a loudspeaker arrangement generally similar to that of FIGS. 2 and 3 above and intended to avoid or reduce the occurrence of a whole body mode in the panel 1, such as might occur when the panel is in close proximity to a boundary so that a cavity is formed between the panel and boundary and modes generated in the fluid in the cavity affect the modes of the panel. This is countered in the arrangement of FIG. 4 by selecting a second exciter driver position, typically on the opposite side of the panel central line from that of the primary exciter 4, and mounting a second exciter 4*a* at the second position so that the exciters 4 and 4*a* work as a pair but with the second exciter connected in reverse polarity to the primary exciter to avoid, reduce or cancel whole body mode. To prevent the second exciter 4*a* from affecting operation of the primary exciter 4 at frequencies other than that of the unwanted whole body modes, a band-pass or low-pass filter 6 is positioned in the signal path to the exciter 4*a* to limit its operation to the frequency range of interest. Instead of connecting the second exciter 4*a* in reverse phase electrically, it would instead be possible to mount the second exciter on the panel at such a position that it is connected in reverse phase mechanically.

Figure 5:
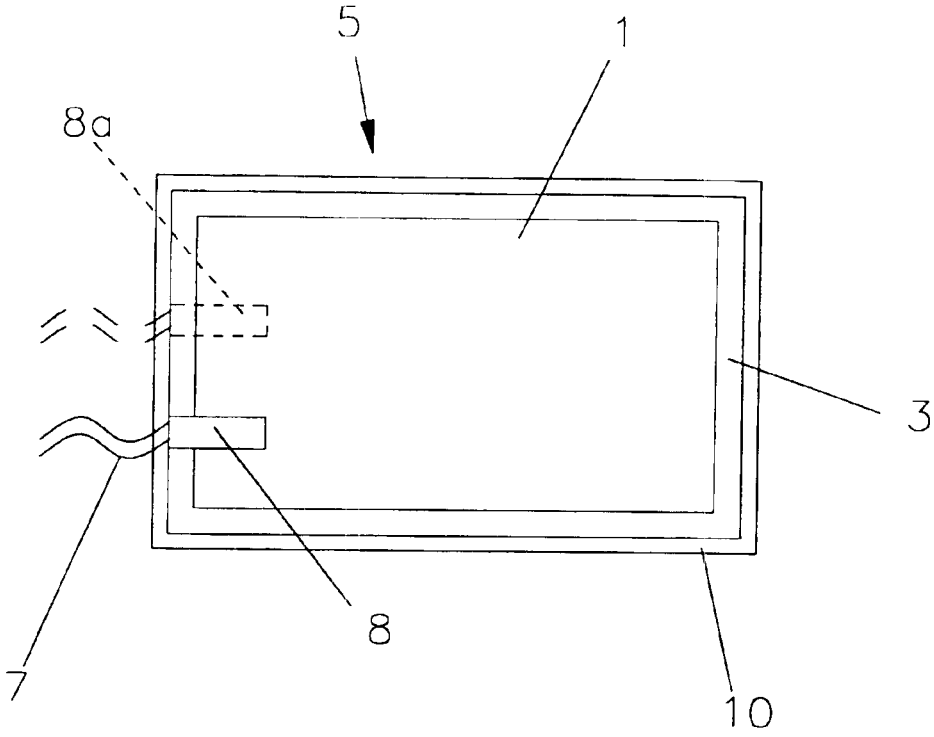
FIG. 5 is a plan view of a third embodiment of loudspeaker according to the invention.
Figure 6:
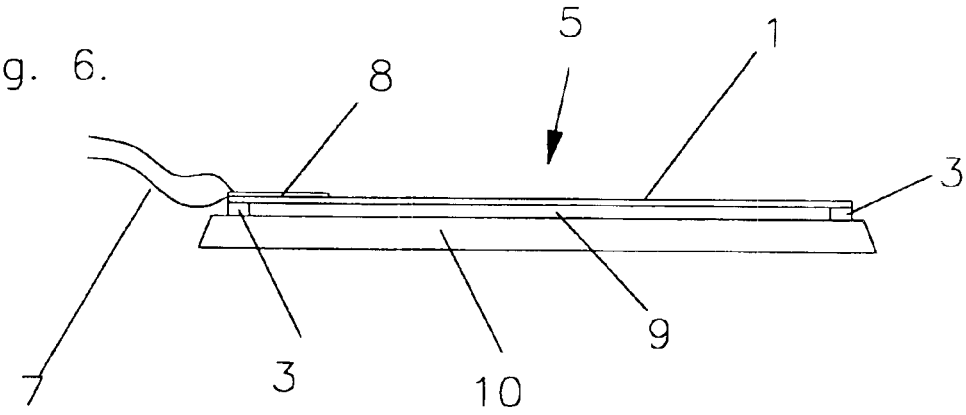
FIG. 6 is a side view of the loudspeaker of FIG. 5.

FIGS. 5 and 6 show an embodiment of loudspeaker 5 particularly applicable to use in a visual display apparatus where the panel 1 is transparent, e.g. of clear polystyrene polycarbonate, acrylic, glass etc. or composites of these materials whereby a visual display panel 10, e.g. a liquid crystal display panel, is visible through the panel 1. In such an arrangement it is, of course, necessary that a vibration exciter 8 does not intrude into the display screen area, and this can be realised by mounting the exciter near to an edge of the panel 1. Also in such an arrangement, the panel 1 is of necessity in close proximity to a boundary formed by the display panel 10 so that a cavity 9 is formed there-between.

In this embodiment, the exciter 8 is a strip of piezoelectric material, e.g. PZT, fixed to the panel 1 by an adhesive to span from the panel edge or periphery to a position inboard of the panel edge. The panel is suspended at its periphery on a high shear stiffness foam plastics so that the suspension forms a hinge or pivot as described above with reference to FIGS. 2 and 3. Thus the exciter 8 is arranged to span a group of nodal lines near to and generally parallel to the panel edge. The exciter 8 is a unimorph device arranged to operate by changes in length to apply shear to the panel face and thus to bend the panel about a fulcrum provided by the suspension 3 at a position local to the exciter.

Since, in this embodiment modes in the fluid in the cavity 9 may adversely affect the modes in the panel 1 so that a whole body mode appears at an undesirably high frequency, a second antiphase exciter 8*a*, generally similar to exciter 8, may be positioned on the panel as described with reference to FIG. 4 above. Alternatively the second exciter 8*a* may be positioned on the panel to act to double the power input to the panel to increase loudness.

If desired, the panel 10 might be transparent, e.g. of glass, so that the loudspeaker 5 may be positioned in front of an object, e.g. a visual display unit, to be viewed through the loudspeaker whereby sound and vision can be correlated. Also the exciters 8, 8*a* may be of transparent piezoelectric material.

It will be appreciated that, if desired, the exciter system comprising the suspension 3 and the piezo unimorph exciter 8 could be used in a loudspeaker not having a back panel 10.

Figure 6A:
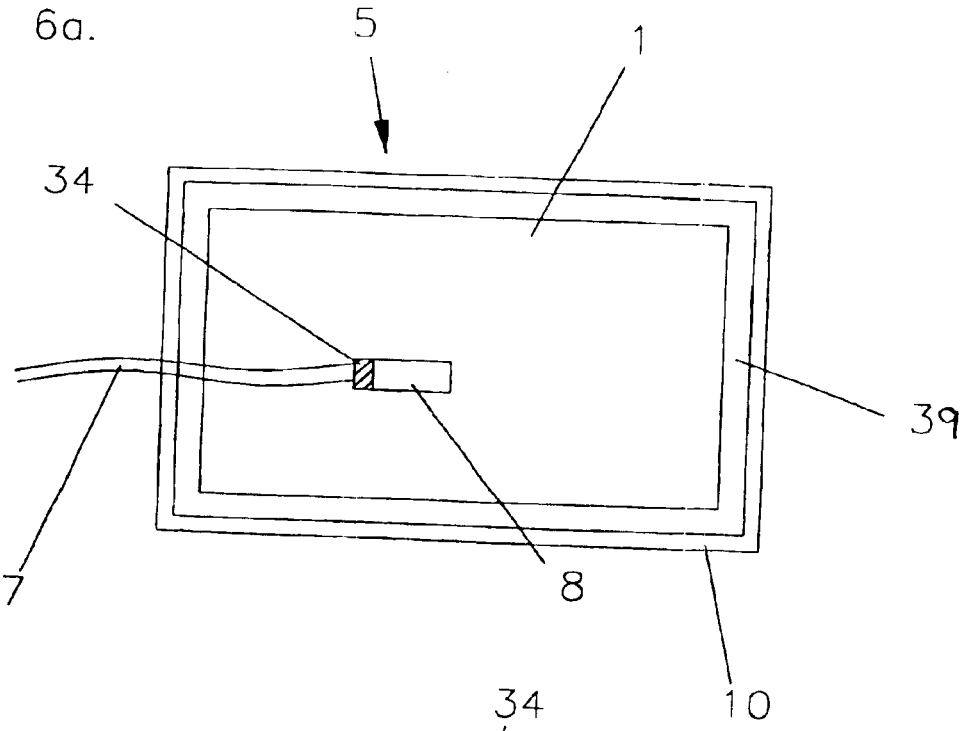
FIG. 6*a* is a plan view of a variant of the loudspeaker shown in FIGS. 5 and 6.

In the loudspeaker embodiments of FIGS. 2 to 6, the high shear stiffness suspension 3 could be replaced by a panel-edge stiffening (not shown) either fixed to the panel edge or integral therewith, with the stiffened edge forming part of the exciter system. The panel edge may thus be freely suspended if desired. Also as shown in FIG. 6*a*, the high shear peripheral suspension 3 can be replaced by an inertial mass 34 suitably positioned at a nodally dense or low bending amplitude region of the panel to form a reference point with the exciter 8 positioned to extend from the reference point to a suitably vibrationally active adjacent area so that the couple applied by the exciter system comprising the inertial mass 34 and the exciter 8 straddles a number or group of nodal lines in similar manner to that explained with reference to FIG. 2*a* above, thus providing good coupling to the region and thence to the panel. In this embodiment, the high shear stiffness suspension 3 is replaced by a resilient edge suspension 39.

Figure 6B:
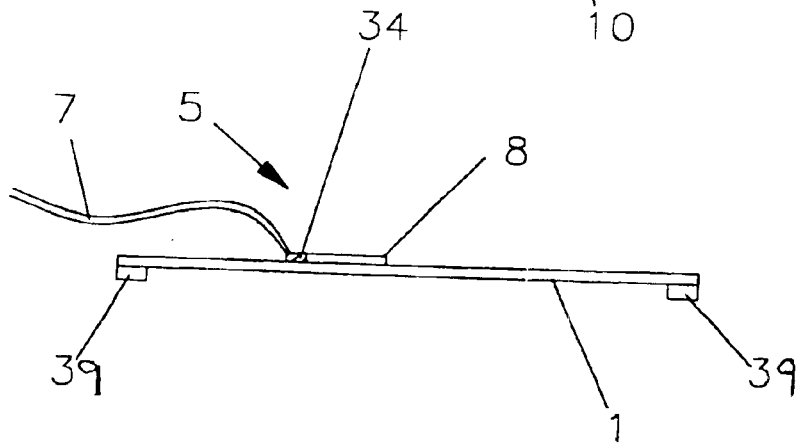
FIG. 6*b* is a side view of a loudspeaker which is a variant of the loudspeaker shown in FIG. 6*a;*

FIG. 6*b* shows an embodiment of loudspeaker 5 generally similar to that of FIG. 6*a* and in which there is no back panel, such as that shown at 10 in FIG. 6*a*.

Figure 6C:
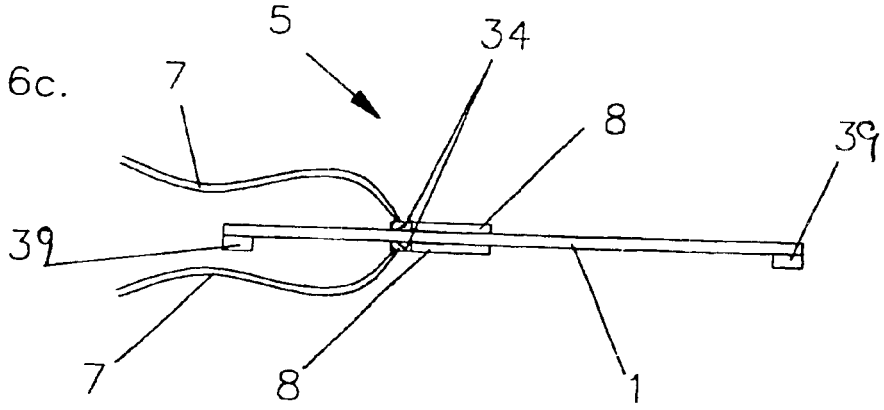
FIG. 6*c* is a side view of a variant of the loudspeaker shown in FIG. 6*b;*

FIG. 6*c* is an embodiment of loudspeaker 5 very similar to that of FIG. 6*b* and comprising an exciter system having an opposed pair of inertial masses 34 and exciters 8 on opposite sides of the panel to reinforce and thus increase the drive and thus the loudness.

The reference point formed by the inertial mass 34 could, if desired, be replaced by a pin or point clamp (not shown) on the panel in the embodiments of FIG. 6*a* to 6*c*.

Figure 7:
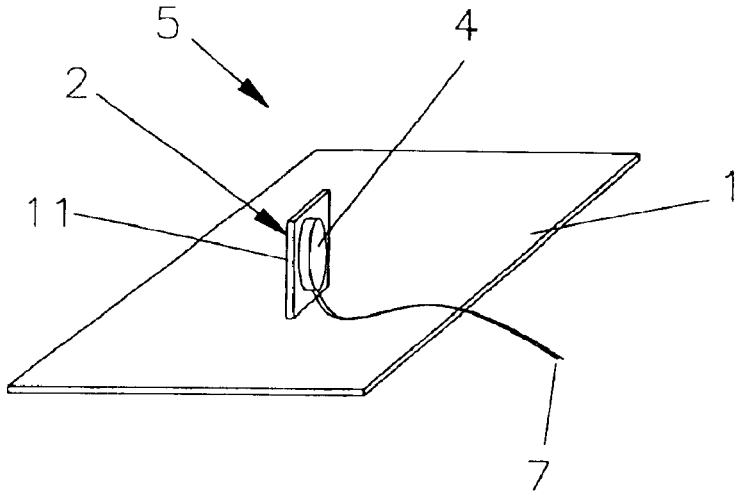
FIG. 7 is a perspective view of a fourth embodiment according to the invention.
Figure 8:
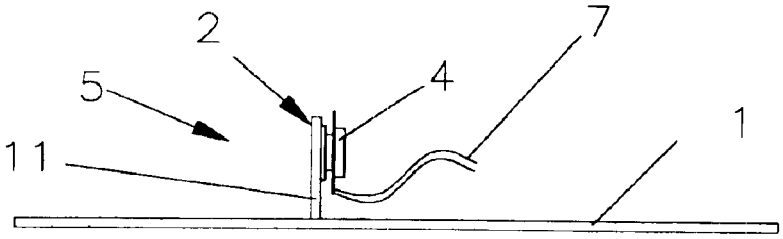
FIG. 8 is a side view of the loudspeaker of FIG. 7.

FIGS. 7 and 8 of the drawings show a resonant panel loudspeaker 5 in which bending wave energy is introduced into a panel 1 via an excitation system 2 comprising a plate-like lever element 11 rigidly mounted on the panel 1 at a suitable nodal position and extending generally at right angles to the plane of the panel 1. An electrodynamic inertial vibration exciter 4 is mounted on the lever element 11 to apply force at right angles to the plane of the element 11 to apply a rotational or bending couple to the panel.

Figure 9:
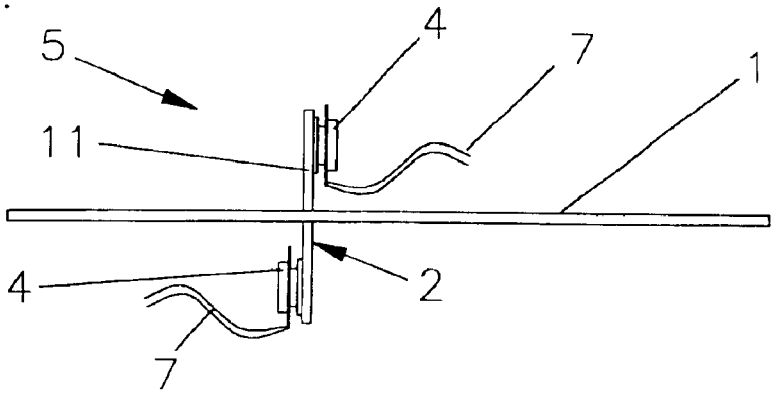
FIG. 9 is a side view of first variant of the loudspeaker of FIGS. 7 and 8.

FIG. 9 shows a first variant of the loudspeaker embodiment of FIG. 8 in which the lever element 11 is extended through the panel 1 whereby opposed exciters 4 can be mounted on opposite ends of the lever element to increase the drive force.

Figure 10:
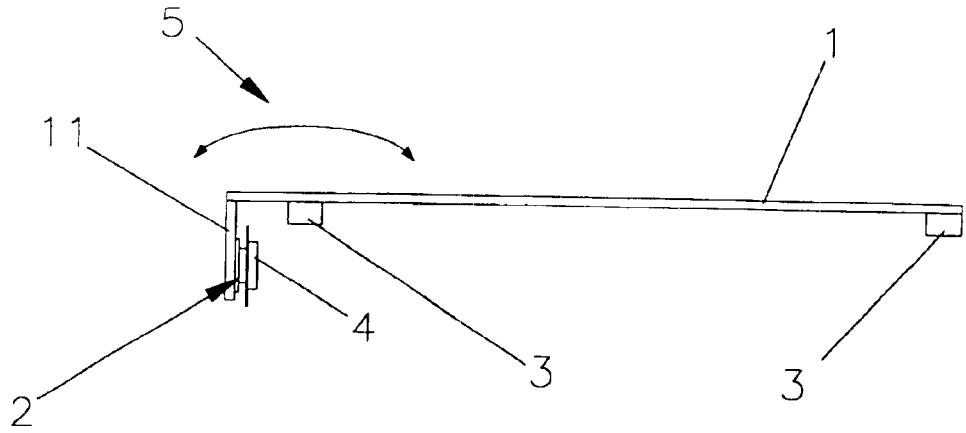
FIGS. 10 and 10*a* are respective side and plan views of a second variant of the loudspeaker of FIGS. 7 and 8.
Figure 10A:
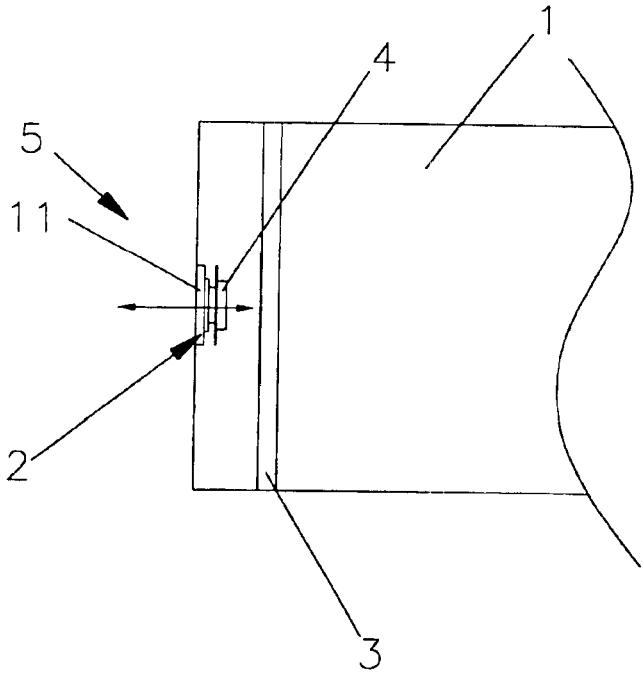

FIGS. 10 and 10*a* show a second variant of the loudspeaker of FIG. 8 in which the panel 1 is mounted on a suspension 3 of the kind described with reference to FIGS. 2 and 3, and the panel is extended on one side beyond this suspension so that an exciting system comprising a lever element 11 and an inertial exciter 4 is mounted outboard of the suspension 3 and operates by bending the panel about the fulcrum provided by the suspension 3.

Figure 11:
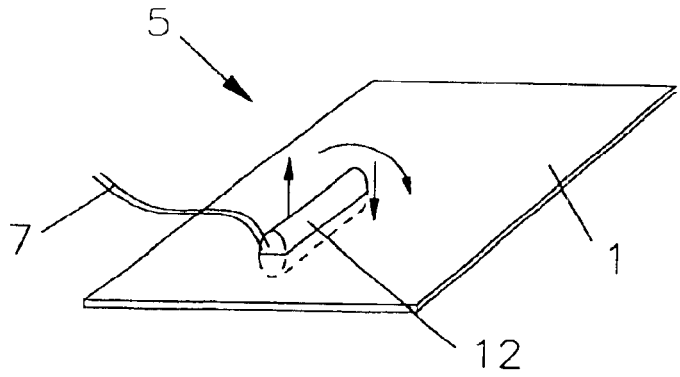
FIG. 11 is a perspective view of a fifth embodiment of loudspeaker according to the present invention.

FIG. 11 shows a loudspeaker 5 in which bending waves are launched into a panel 1 via a rotary or torsional electrodynamic vibration exciter 12 mounted in a slot in the panel. This class of exciter is described more fully with reference to FIGS. 17 to 21 below.

Figure 12:
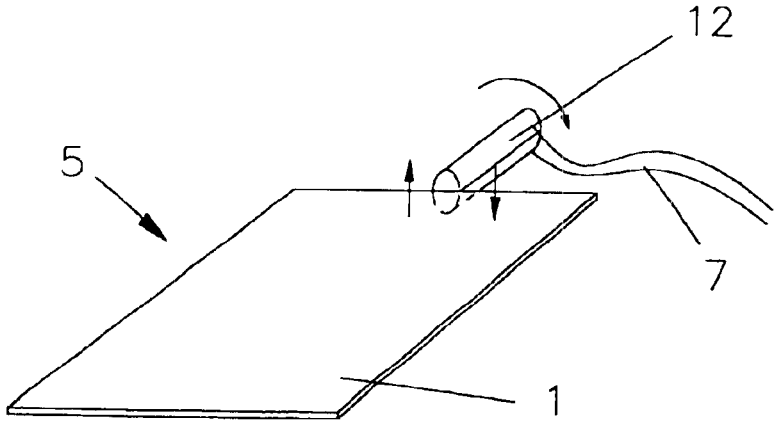
FIG. 12 is a perspective view of a first variant of the loudspeaker of FIG. 11.

FIG. 12 shows a variant of the loudspeaker of FIG. 11 in which the rotational or torsional exciter 12 is coupled to an edge of the panel 1 so that the exciter is disposed outboard of the panel.

Figure 13:
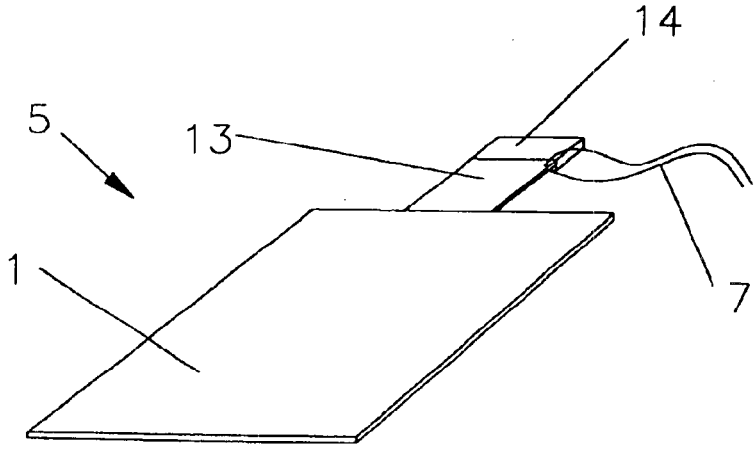
FIG. 13 is a perspective view of a second variant of the loudspeaker of FIG. 11.

FIG. 13 shows a variant of the loudspeaker of FIG. 12, in which a torsional piezoelectric vibration exciter 13 is coupled to an edge of a panel 1 and has at its distal end an inertial mass 14 or instead is grounded e.g. to a loudspeaker frame (not shown). Such an arrangement is shown in more detail in FIGS. 24 to 26 below.

Figure 14:
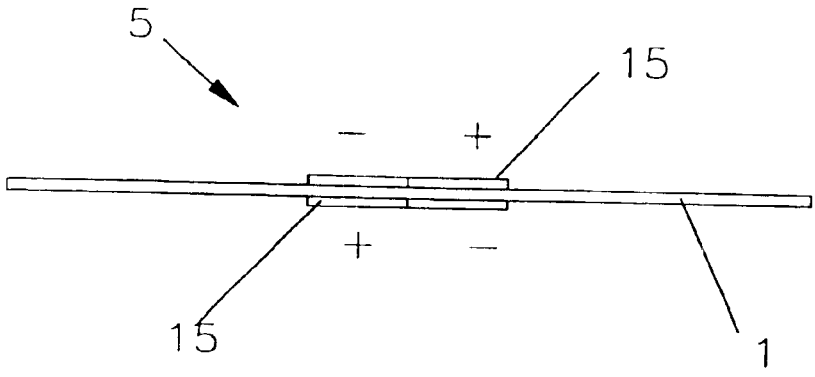
FIG. 14 is a side view of a sixth loudspeaker according to the present invention.
Figure 15:
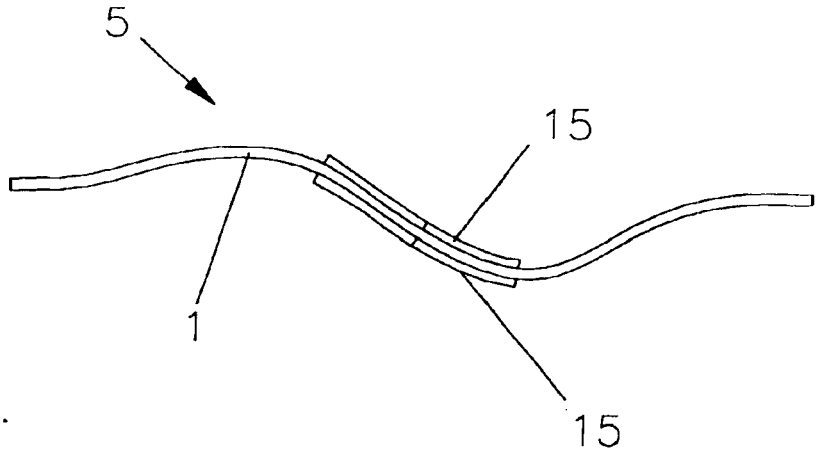
FIG. 15 is a side view of the loudspeaker of FIG. 14 and showing diagrammatically how the loudspeaker panel will be bent in operation.
Figure 16:
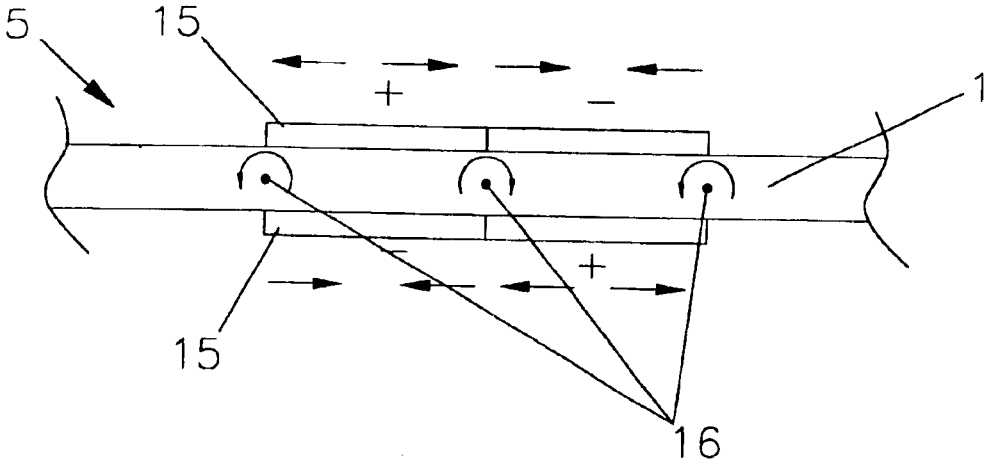
FIG. 16 is a side view, to an enlarged scale, of part of the loudspeaker of FIG. 14 and showing details of a vibration exciter.

FIGS. 14 to 16 of the drawings show a loudspeaker 5 in which a panel 1 is excited with bending wave energy by means of a pair of piezoelectric differential exciters 15 disposed in opposed positions on opposite faces of the panel 1. Each of the exciters 15 comprises an opposed unimorph pair of opposing orientation, indicated by the positive and minus signs in the drawings, joined end to end to form a strip. The exciters work by changes in length and thus while one half of each exciter is contracting in length, the other is extending. The exciter on one side of the panel is arranged to oppose the exciter on the other side. The exciters thus apply shear forces to the panel to cause it to bend with a double curvature as shown in FIG. 15. The rotational couples and their axes 16 are illustrated in FIG. 16. The exciters may be of PZT material.

Figure 17:
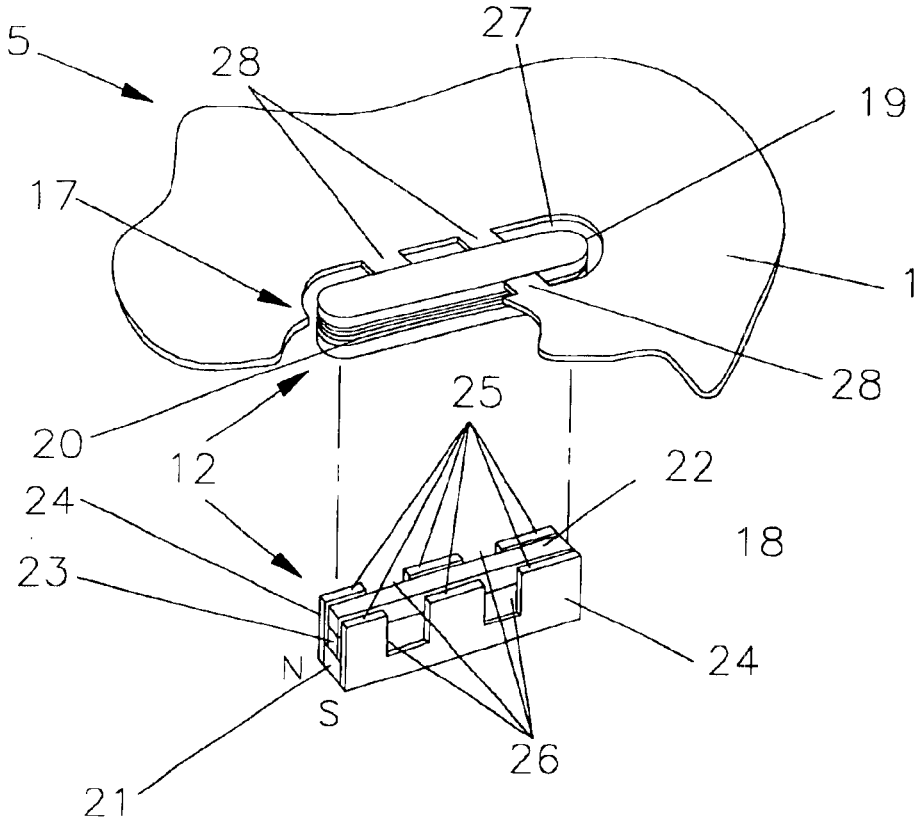
FIG. 17 is an exploded perspective view of part of a loudspeaker and showing a seventh embodiment of the invention comprising an electrodynamic torsional vibration exciter.
Figure 18:
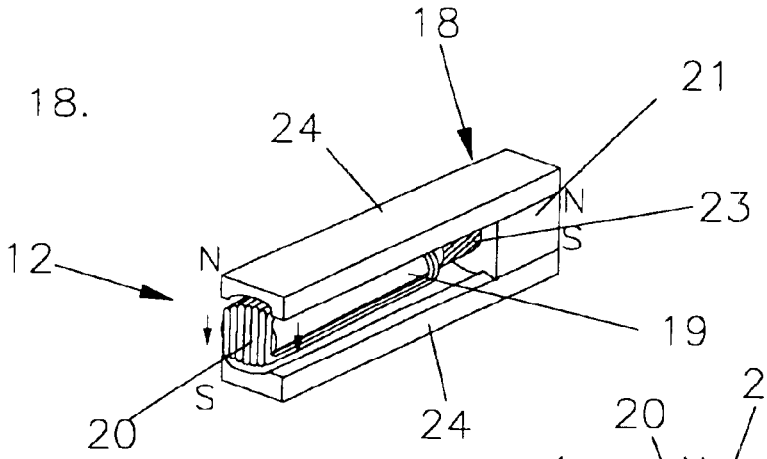
FIG. 18 is a perspective view of a further embodiment of electrodynamic torsional vibration exciter for a loudspeaker.

FIG. 17 shows an embodiment of loudspeaker having an electrodynamic torsional vibration exciter 12 of the inertial kind and comprising a voice coil 17 and a magnet system 18 forming a motor in which the voice coil is the rotor. The voice coil 17 comprises a coil 20 wound onto a former 19 which is flattened and elongated to form two parallel sets of windings. The magnetic system 18 comprises a permanent bar magnet 21 on which a pole 22 is centrally mounted, supported on a non-magnetic spacer 23. The pole 22 and magnet 21 are sandwiched between side plates 24 having castellations 25 defining notches 26.

Since the exciter 12 is a torsional device, the axis of rotation of the rotor formed by the voice coil is in the plane of the panel 1 to ensure that no unwanted moments are applied. A sufficient clearance between coil and magnet assembly must be provided to allow sufficient angular rotation between the two to occur.

As shown the coil 17 is fixed by its opposite sides in a slot or aperture 27 in the panel, and since the flux needs to pass through the coil, sections of the side plates 24 are removed to form the notches 26 to accommodate coil/panel fixing tabs 28. These fixing tabs 28 extend inwards from the slot 27 to contact and mount the voice coil on the panel 1. The tabs 28 can be fixed to the voice coil 17 by adhesive means. The magnet system 18 can be attached to the panel with a simple suspension means, e.g. resilient means (not shown).

The magnet system 18 could, if desired, also be fixed to a reference ground.

An alternative embodiment of inertial torsional electrodynamic motor vibration exciter 12 which reduces shear in the coil former is shown in FIGS. 18 to 21 in which a coil 20 is mounted on a cylindrical former tube 19 to form a rotor. By winding the coil 20 along a tubular former 19, the effects of shear are reduced. A flexible printed circuit 29 could also form the windings, and which is subsequently wrapped around the coil 20 as shown in FIGS. 21*a* and 21*b*. PADDICK, U.S. Pat. No. 5,446,979 shows such a method for conventional circular voice coils, but in the present application we propose to wind the conductor along the length of the tubular former. The magnetic system 18 is formed by a permanent magnet 21, connected to outer pole pieces 24, forming a North Pole and South Pole whilst a central cylindrical pole 22 is held in place on the magnet 21 by a non-magnetic spacer 23.

Figure 19:
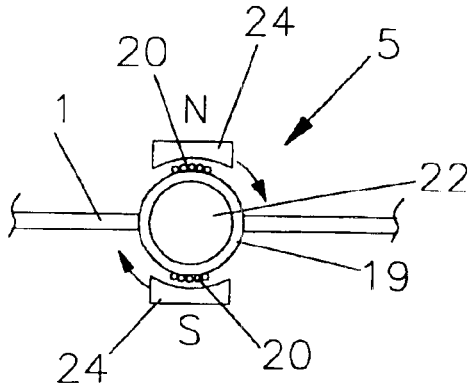
FIG. 19 is an end view of the exciter of FIG. 18 in position in a loudspeaker.

As shown in FIGS. 19 and 20, the exciter 12 is mounted in a slot 27 in a panel 1 with its axis in the plane of the panel and with opposite sides of the coil former 19 fixed to the panel 1 to apply an alternating couple thereto when a signal is applied to the coil. The magnet system 18 may be mounted on a resilient suspension (not shown) such that the device operates as an inertial exciter due to the mass of the magnet system.

Figure 22:
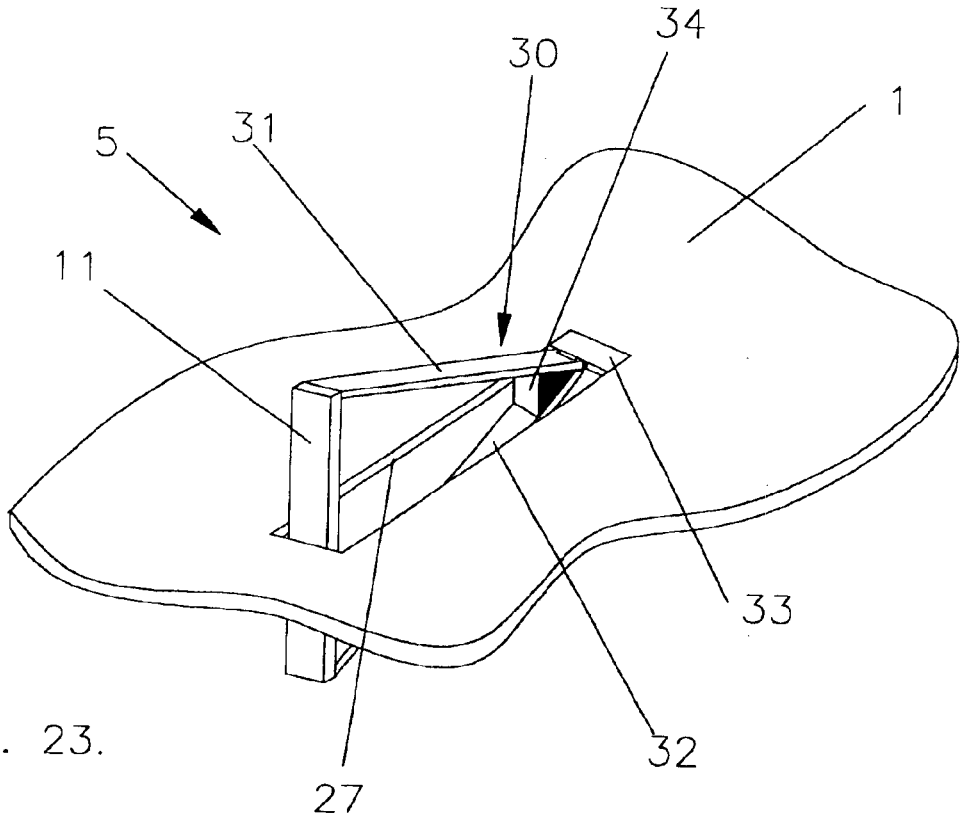
FIG. 22 is a perspective view of part of a further embodiment of loudspeaker.
Figure 23:
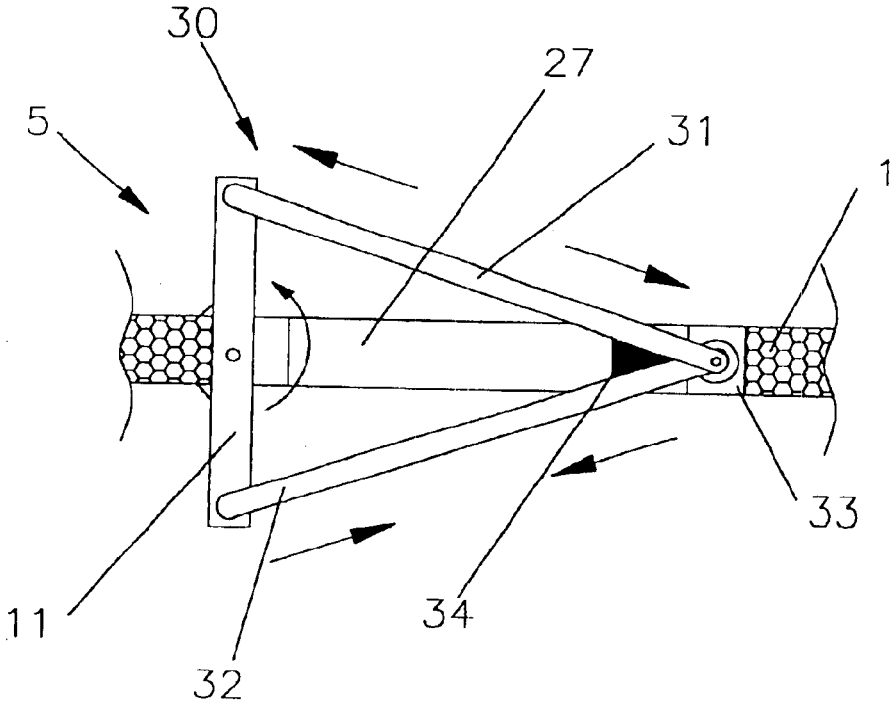
FIG. 23 is a cross-sectional view of the part of a loudspeaker shown in FIG. 22.

As shown in FIGS. 22 and 23, it is also possible to introduce torsion into the panel by using an exciter 30 comprising a pair of unimorph piezoelectric elements, 31, 32 mounted in a slot 27 in the panel 1 and attached to opposite ends of a lever 11 extending through the panel and rigidly attached at one end of the slot. The elements 31, 32 are set at an angle, connected to the opposite ends of a lever 11, and at their opposite ends are connected together.

The first piezoelectric element 31, which will increase in length when a voltage is applied to its electrodes is attached to upper end of lever 11, with its opposite end connected to an inertial mass 34 embedded or suspended on the panel 1. The second piezoelectric element 32 is located on the opposite side of the panel, and is electrically connected in opposition to the first, such that a voltage applied to its electrodes causes it to shorten. One end of element 32 is connected to the lower end of the lever and the other end to the inertial mass 34. The actions of the two piezoelectric devices together produce a moment on the lever which introduces bending waves into the panel. A reference point is provided either by the inertial mass 34, or a connection is made to a ground to provide a reference point.

The lever exciter 30 is located with respect to the panel to introduce the maximum rotation, as well as the optimal modal density. This could be completely let into the panel, as shown, or attached at or near to the edge of the panel. A number of such exciters could be arranged to introduce bending waves in concert to improve modal density.

FIGS. 24 to 26 show an embodiment of torsional vibration exciter 13 for a loudspeaker 5 of the kind shown in FIG. 13, comprising a generally rectangular bimorph piezoelectric twister 35 having a top element 36 orientated diagonally and a bottom element 37 orientated diagonally such that an applied voltage causes the top element to contract diagonally while the bottom element is caused to expand diagonally as indicated by arrows in FIG. 24*a*, the top and bottom elements being cemented together to form a bimorph bender with a resulting twisting action. This exciter might be used directly on a panel 1 to excite the panel to resonate, but a further refinement could be to ground one end of the bimorph as shown at 38 where the twisting now occurs at the ungrounded end, but the magnitude is doubled. This ground could take the form of a substantial frame, or may be an inertial mass.

The invention describes a new class of loudspeaker and vibration exciters for loudspeakers and which work in torsion and which exhibit possible advantages over force exciters in their ability to operate at different locations on a panel member to be vibrated as compared to force exciters and in their ability to prevent or reduce whole body moments in the panel member to be vibrated.

What is claimed is:

1. A loudspeaker comprising:

a panel-form member mounted on a suspension; and a vibration exciting system mounted on the panel-form member;

the vibration exciting system being adapted to apply bending wave energy to the panel-form member and cause resonance, thereby producing an acoustic output;

wherein the suspension acts as a pivot, thereby supporting the panel-form member in a simple fashion and causing nodal lines corresponding to the resonance of the panel-form member to move towards an edge of the member as compared to a generally corresponding but resiliently or freely edge-suspended panel-form member;

the vibration exciting system being positioned so as to bridge across several of said nodal lines.

2. A loudspeaker according to claim 1, wherein the vibration exciting system is adapted to apply shear to the panel-form member.

3. A loudspeaker according to claim 1, wherein the vibration exciting system comprises a piezoelectric device attached to the panel-form member to apply a bending couple thereto by introducing alternating tension and compression to the panel-form member in the plane thereof.

4. A loudspeaker according to claim 3, wherein the piezoelectric device is attached to a face of the panel-form member.

5. A loudspeaker according to claim 4, comprising mirror-image piezoelectric devices attached to opposite faces of the panel-form member.

6. A loudspeaker according to claim 3, wherein the piezoelectric device has a portion disposed adjacent to the suspension, and a portion disposed remotely from the suspension.

7. A loudspeaker according to claim 3, wherein the piezoelectric device is a thin strip-like device fixed to the panel-form member by adhesive.

8. A loudspeaker according to claim 3, wherein the piezoelectric device is a unimorph device.

9. A loudspeaker according to claim 8, wherein the unimorph device comprises opposed parts arranged such that one part increases in length while the other part contracts.

10. A loudspeaker according to claim 1 or claim 3, wherein the panel-form member is transparent.

11. A loudspeaker according to claim 10, wherein the piezoelectric device is transparent.

12. A loudspeaker according to claim 3, wherein the piezoelectric device is of PZT.

13. A loudspeaker according to claim 1, wherein the vibration exciting system comprises an inertial device.

14. A loudspeaker according to claim 13, wherein the inertial device comprises an inertial mass rigidly fixed to the panel-form member to form a suspension pivot.

15. A loudspeaker according to claim 13, wherein the inertial device is an inertial vibration exciter.

16. A loudspeaker according to claim 15, comprising opposed inertial vibration exciters on opposite sides of the panel-form member.

17. A loudspeaker according to claim 15, comprising an additional inertial vibration exciter on the panel-form member and coupled to the first said inertial vibration exciter in anti-phase to damp unwanted whole body movement of the panel-form member.

18. A loudspeaker according to claim 1, wherein said suspension comprises a high shear stiffness material.

19. A loudspeaker according to claim 18, wherein said suspension comprises high shear stiffness foam plastics material.

20. A loudspeaker according to claim 1, claim 18 or claim 19, wherein the suspension acts as a pivot only in the region local to the vibration exciting system.

21. A loudspeaker according to claim 20, wherein the suspension in regions other than the region local to the vibration exciting system is resilient.

22. A loudspeaker according to claim 21, wherein the suspension in regions other than the region local to the vibration exciting system is soft foam material.

* * * * *